United States Patent [19]

Dickakian

[11] 4,363,715

[45] Dec. 14, 1982

[54] PRODUCTION OF CARBON ARTIFACT PRECURSORS

[75] Inventor: Ghazi Dickakian, Scotch Plains, N.J.

[73] Assignee: Exxon Research and Engineering Co., Florham Park, N.J.

[21] Appl. No.: 225,060

[22] Filed: Jan. 14, 1981

[51] Int. Cl.[3] ..... C10C 1/20; C10C 1/18

[52] U.S. Cl. ..... 208/40; 208/44; 208/45

[58] Field of Search ..... 208/40, 42, 44, 45

[56] References Cited

U.S. PATENT DOCUMENTS

| | | | |
|---|---|---|---|
| 2,992,181 | 7/1961 | Renner | 208/22 |
| 3,692,663 | 9/1972 | Ueda | 208/44 |
| 3,919,376 | 11/1975 | Schulz | 264/102 |
| 4,184,942 | 1/1980 | Angier et al. | 208/44 |
| 4,208,267 | 6/1980 | Diefendorf | 208/22 |
| 4,219,404 | 8/1980 | Dickakian | 208/39 |
| 4,277,324 | 7/1981 | Greenwood | 208/45 |

*Primary Examiner*—Winston A. Douglas
*Assistant Examiner*—William Leader
*Attorney, Agent, or Firm*—Joseph J. Dvorak; Robert S. Salzman

[57] ABSTRACT

A low coking pitch suitable for carbon artifact manufacture, especially carbon fiber manufacture, is obtained by heat soaking and vacuum stripping the distillate recovered from cat cracker bottoms. Preferably a cat cracker bottom distillate boiling in the range of about 450° C. to 510° C. at 760 mm Hg is heat soaked at about 350° C. to about 500° C. for up to about 20 hours and then vacuum stripped at below 400° C.

11 Claims, No Drawings

PRODUCTION OF CARBON ARTIFACT PRECURSORS

FIELD OF THE INVENTION

This invention is concerned generally with the preparation of a feedstock for carbon artifact manufacture from cat cracker residues.

BACKGROUND OF THE INVENTION

As is well known, the catalytic conversion of virgin gas oils containing aromatic, naphthenic and paraffinic molecules results in the formation of a variety of distillates that have ever-increasing utility and importance in the petrochemical industry. The economic and utilitarian value, however, of the residual fraction of the cat cracking processes has not increased to the same extent as the light overhead fractions has. One potential use for such cat cracker bottoms is in the manufacture of carbon artifacts. As is well known, carbon artifacts have been made by pyrolyzing a wide variety of organic materials. Indeed, one carbon artifact of particularly important commercial interest today is carbon fiber. Hence, particular reference is made herein to carbon fiber technology. Nevertheless, it should be appreciated that this invention has applicability to carbon artifact formation generally and, most particularly, to the production of shaped carbon articles in the form of filaments, yarns, films, ribbons, sheets, and the like.

Referring now in particular to carbon fibers, suffice it to say that the use of carbon fibers in reinforcing plastic and metal matrices has gained considerable commercial acceptance where the exceptional properties of the reinforcing composite materials, such as their higher strength to weight ratio, clearly offset the generally higher costs associated with preparing them. It is generally accepted that large scale use of carbon fibers as a reinforcing material would gain even greater acceptance in the marketplace if the costs associated with the formation of the fibers could be substantially reduced. Thus, the formation of carbon fibers from relatively inexpensive carbonaceous pitches has received considerable attention in recent years.

Many carbonaceous pitches are known to be converted at the early stages of carbonization to a structurally ordered optically anisotropic spherical liquid crystal called mesophase. The presence of this ordered structure prior to carbonization is considered to be a significant determinant of the fundamental properties of any carbon artifact made from such a carbonaceous pitch. Indeed, the ability to generate high optical anisotropicity during processing is accepted, particularly in carbon fiber production, as a prerequisite to the formation of high quality products. Thus, one of the first requirements of a feedstock material suitable for carbon artifact manufacture, and particularly carbon fiber production, is its ability to be converted to a highly optically anisotropic material.

In addition to being able to develop a highly ordered structure, suitable feedstocks for carbon artifact manufacture, and in particular carbon fiber manufacture, should have relatively low softening points rendering them suitable for being deformed and shaped into desired articles. Thus, in carbon fiber manufacture, a suitable pitch which is capable of generating the requisite highly ordered structure also must exhibit sufficient viscosity for spinning. Unfortunately, many carbonaceous pitches have relatively high softening points.

Indeed, incipient coking frequently occurs in such materials at temperatures where they have sufficient viscosity for spinning. The presence of coke, however, or other infusible materials and/or undesirably high softening point components generated prior to or at the spinning temperatures are detrimental to processability and are believed to be detrimental to product quality. Thus, for example, U.S. Pat. No. 3,919,376 discloses the difficulty in deforming pitches which undergo coking and/or polymerization at the softening temperature of the pitch.

Another important characteristic of the feedstock for carbon artifact manufacture is its rate of conversion to a suitable optically anisotropic material. For example, in the above-mentioned U.S. patent, it is disclosed that 350° C. is the minimum temperature generally required to produce mesophase from a carbonaceous pitch. More importantly, however, is the fact that at least one week of heating is necessary to produce a mesophase content of about 40% at that minimum temperature. Mesophase, of course, can be generated in shorter times by heating at higher temperatures. However, as indicated above, at temperatures in excess of about 425° C., incipient coking and other undesirable side reactions do take place which can be detrimental to the ultimate product quality.

In U.S. Pat. No. 4,208,267, it has been disclosed that typical graphitizable carbonaceous pitches contain a separable fraction which possesses very important physical and chemical properties insofar as carbon fiber processing is concerned. Indeed, the separable fraction of typical graphitizable carbonaceous pitches exhibits a softening range and viscosity suitable for spinning and has the ability to be converted rapidly at temperatures in the range generally of about 230° C. to about 400° C. to an optically anisotropic deformable pitch containing greater than 75% of a liquid crystalline type structure. Unfortunately, the amount of separable fraction present in well known commercially available petroleum pitches, such as Ashland 240 and Ashland 260, to mention a few, is exceedingly low. For example, with Ashland 240, no more than about 10% of the pitch constitutes a separable fraction capable of being thermally converted to a deformable anisotropic phase.

In U.S. Pat. No. 4,184,942, it has been disclosed that the amount of that fraction of typical graphitizable carbonaceous pitches that exhibits a softening point and viscosity which is suitable for spinning and which has the ability to be rapidly converted at low temperatures to highly optically anisotropic deformable pitch can be increased by heat soaking the pitch, for example at temperatures in the range of 350° C. to 450° C., until spherules visible under polarized light begin to appear in the pitch. The heat soaking of such pitch results in an increase in the amount of the fraction of the pitch capable of being converted to an optically anisotropic phase.

In U.S. Pat. No. 4,219,404, it has been disclosed that the polycondensed aromatic oils present in isotropic graphitizable pitches are generally detrimental to the rate of formation of highly optically anisotropic material in such feedstocks when they are heated at elevated temperatures and that, in preparing a feedstock for carbon artifact manufacture, it is particularly advantageous to remove at least a portion of the polycondensed aromatic oils normally present in the pitch simultaneously with, or prior to, heat soaking of the pitch for converting it into a feedstock suitable in carbon artifact manufacture.

More recently, in copending application Ser. No. 143,136, filed Apr. 23, 1980 now U.S. Pat. No. 4,271,006, a process has been disclosed for converting cat cracker bottoms to a feed stock suitable in carbon artifact manufacture. Basically, the process requires stripping cat cracker bottoms of fractions boiling below 400° C. and thereafter heat soaking the residue followed by vacuum stripping to provide a carbonaceous pitch.

SUMMARY OF THE INVENTION

It has now been discovered that the distillates recovered from the residual materials generated in cat cracking processes can be readily converted into a low coking pitch which is eminently suitable for carbon artifact manufacture. Basically, the distillate is converted into the pitch by heat soaking the distillate fraction at elevated temperatures, for example, temperatures ranging from about 350° C. to 500° C. and for times ranging up to about twenty hours and thereafter subjecting the heat treated material to a vacuum stripping step to remove at least a portion of the oil present in the heat treated distillate, thereby providing a pitch suitable for carbon artifact manufacture.

Full appreciation of all the ramifications of the present invention will be more readily understood upon a reading of the detailed description which follows:

DETAILED DESCRIPTION OF THE INVENTION

The term catalytic cracking refers to a thermal and catalytic conversion of gas oils, particularly virgin gas oils, boiling generally between about 316° C. and 566° C., into lighter, more valuable products.

Cat cracker bottoms refer to that fraction of the product of the cat cracking process which boils in the range of from about 200° C. to about 550° C.

Cat cracker bottoms typically have relatively low aromaticity as compared with graphitizable isotropic carbonaceous pitches suitable in carbon artifact manufacture.

Specifications for a typical cat cracker bottom that is suitable in the present invention are given in Table I.

TABLE I

| | Range |
|---|---|
| Physical Characteristics | |
| Viscosity cst at 210° F. | 1.0–10.0 |
| Ash content, wt. % | 0.010–2.0 |
| Coking value (wt. % at 550° C.) | 6.0–18.0 |
| Asphaltene (n-heptane insoluble), % | 0.1–12.0 |
| Toluene insolubles (0.35μ), % | 0.010–1.0 |
| Number average mol. wt. | 220–290 |
| Elemental Analysis | |
| Carbon, % | 88.0–90.32 |
| Hydrogen, % | 7.74–7.40 |
| Oxygen, % | 0.10–0.30 |
| Sulfur, % | 1.0–4.5 |
| Chemical Analysis (proton NMR) | |
| Aromatic carbon (atom %) | 54–64 |
| Carbon/hydrogen atomic ratio | 0.90–1.0 |
| Asphaltene Analysis | |
| Number average mol. wt. | 550–750 |
| Coking value, wt. % at 550° C. | 3.5–6.5 |
| Aromatic carbon (atom %) | 55–70 |
| Bureau of Mines Correlation Index | 120–140 |

In the process of the present invention, the cat cracker bottoms are fractionally distilled by heating the cat cracker bottom to elevated temperatures and reduced pressures, for example, by heating to temperatures in the range of 200° C. to 300° C. at pressures ranging from about 250 to 500 microns of mercury. Basically, the cat cracker bottom is separated into at least a single distillate having a boiling point at 760 mm mercury in the range of from about 250° C. to about 310° C., and the residue being the fraction not distillable at temperatures up to 530° C. at a pressure of about 350 to 450 microns of mercury. In a particularly preferred embodiment of the present invention, the distillate fraction of the cat cracking bottom which is employed in forming a suitable carbonaceous pitch for carbon artifact manufacture is that fraction boiling in the range of about 450° C. to about 510° C. at 760 mm of mercury. After separating the distillate from the cat cracking bottom, the distillate is heat soaked at temperatures in the range of about 350° C. to 500° C. Optionally and preferably, the heat soaking is conducted at temperatures in the range of about 390° C. to about 450° C., and most preferably at temperatures in the range of about 410° C. to about 440° C. In general, heat soaking is conducted for times ranging from one minute to about twently hours, and preferably from about two to five hours. In the practice of the present invention, it is particularly preferred that heat soaking be done in an atmosphere such as nitrogen, or alternatively in hydrogen atmosphere. Optionally, however, heat soaking may be conducted at reduced pressures, for example, pressures in the range of from about 50 to 100 mm of mercury.

After heat soaking the distillate, the heat soaked distillate is then heated in a vacuum at temperatures generally below about 400° C., and typically in the range of about 320° C. to 380° C. at pressures below atmospheric pressure generally in the range of about 1.0 to 100 mm mercury to remove at least a portion of the oil present in the heat soaked distillate. Typically from about 20% to about 60% of the oil present in the heat soaked distillate is removed.

As can be readily appreciated, the severity of the heat soaking conditions outlined above will affect the nature of the pitch produced. The higher the temperature chosen for heat soaking and the longer the time chosen, the greater the amount of high softening point components that will be generated in the pitch. Consequently, the precise conditions selected for carrying out the heat soaking depend, to an extent, on the use to which the pitch is to be put. Thus, where low softening point is a desirable property of the product pitch, less severe heat soaking conditions will be chosen within the parameters outlined above.

As indicated in copending application Ser. No. 143,136, filed Apr. 23, 1980, the heat soaking of cat cracker bottoms and subsequent vacuum stripping can lead to a pitch which may contain as low as 0.5% and as high as 60%, for example, of materials which are insoluble in quinoline at 75° C. The quinoline insoluble material present in such heat soaked cat cracker bottom typically consist of coke, ash, catalyst fines, and the like, including high softening point materials generated during heat soaking and carbon fiber manufacture these high softening point materials are detrimental to processability of the pitch into fibers. Consequently, when the heat soaked cat cracker bottom is to be used in carbon fiber production, it is important to remove the undesirable high softening components present in the pitch. In employing a distillate from a cat cracker bottom, which has been treated in accordance with the present invention, it is not necessary to remove the quinoline insoluble materials, since heat soaking conditions can be chosen which do not generate large amounts of quinoline insoluble material, especially coke-like material. Moreover, since a distillate is used, the resultant pitch material is free from the ash and catalyst fines normally present in other petroleum pitches and residues. Additionally, it has been discovered that a distillate from a cat cracker bottom does not have a significant coking value. Consequently, coke is not generated during heat soaking of the distillate.

In Table II below the coking value (SMTTP Test Method No. PT-10-67) for a commercially available petroleum pitch Ashland 240 is given along with the coking value for a cat cracker bottom, a cat cracker bottom distillate obtained in accordance with the present invention, and the residue of the distilled cat cracker bottom.

TABLE II

| Material Used | Standard Coking Value at 550°, % |
|---|---|
| Ashland 240 | 56.0% |
| Cat cracker bottom | 6.5% |
| Cat cracker bottom distillates | nil |
| Cat cracker bottom residue | 26.1% |

As is disclosed in U.S. Pat. No. 4,208,267, in carbon fiber manufacture, it is particularly beneficial to use a fraction of the pitch which is readily convertible into a deformable optically anisotropic phase. Consequently, in the process of the present invention, it is particularly preferred to isolate that fraction of the heat soaked and vacuum stripped cat cracker distillate which is readily convertible into a deformable optically anisotropic phase. The preferred technique for isolating that fraction of the pitch is set forth in U.S. Pat. No. 4,208,267, which patent is incorporated herein by reference. Basically, that process requires treatment of the pitch with the solvent system which consists of a solvent or mixture of solvents that has a solubility parameter of between 8.0 and 9.5 and preferably between about 8.7 and 9.2 at 25° C. The solubility parameter $\gamma$ of a solvent or mixture of solvents is given by the expression $$\gamma = \left(\frac{H_v - RT}{V}\right)^{\frac{1}{2}}$$

where $H_v$ is the heat of vaporization of material, R is the molar gas constant, T is the temperature in degrees K., and V is the molar volume.

In this regard, see, for example, J. Hildebrand and R. Scott, "Solubility of Non-Electrolytes," 3rd edition, Reinhold Publishing Company, New York (1949), and "Regular Solutions," Prentice Hall, New Jersey (1962). Solubility parameters at 25° C. for hydrocarbons and commercial $C_6$ to $C_8$ solvents are as follows: benzene, 8.2; toluene, 8.9; xylene, 8.8; n-hexane, 7.3; n-heptane, 7.4; methylcyclohexane, 7.8; bis-cyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred having greater than about 60 volume % toluene, such as 60% toluene/40% heptane and 85% toluene/15% heptane.

The amount of solvent employed will be sufficient to provide a solvent insoluble fraction capable of being thermally converted to greater than 75% of an optically anisotropic material in less than 10 minutes. Typically the ratio of solvent to pitch will be in the range of about 5 milliliters to about 150 milliliters of solvent to a gram of pitch. After heating the solvent, the solvent insoluble fraction can be readily separated by techniques such as sedimentation, centrifugation, filtration and the like. Any of the solvent insoluble fraction of the pitch prepared in accordance with the process of the present invention is eminently suitable for carbon fiber production.

In Table III below a comparison is made between the two different pitches, one obtained by vacuum stripping and heat soaking of cat cracker bottom, the other obtained in accordance with the practice of the present invention. As can be seen in Table III below, the pitch that was obtained by the heat soaking and vacuum stripping a cat cracker bottom contained considerably more quinoline insoluble material as determined by the ASTM Test Method No. D2318/76. Thus, although high yields were obtained of desirable material insoluble in toluene in each instance, a material prepared in accordance with the present invention did not necessitate treatment to remove the quinoline insoluble materials because of their relatively low content.

TABLE III

| Feed | Heat Soak Conditions Temp °C. | Heat Soak Conditions Time Hrs. | Qi(ASTM) in Pitch, % |
|---|---|---|---|
| Vacuum Stripped - Cat Cracker Bottom | 430 | 3 | 9.9 |
| Distillate of Cat Cracker Bottom | 430 | 3 | 0.8 |

As should be appreciated, however, in the practice of the present invention, the severity of the heat soaking conditions can lead to higher levels of quinoline insoluble material than might be desirable in the feed stock. Although the total amount of toluene insoluble material of that fraction of the pitch suitable in carbon artifact manufacture may be increased, it may be necessary to treat the pitch prepared from the cat cracker bottom in such a manner as to remove the quinoline insoluble components generated during the heat soaking. A particularly preferred technique for removing these components is disclosed in copending application Ser. No. 29,760 filed Apr. 13, 1979 now U.S. Pat. No. 4,277,324, which aplication is incorporated herein by reference. Basically, the heat soaked pitch is fluxed, i.e., it is treated with an organic liquid in the range, for example, of from about 0.5 parts by weight of organic liquid per weight of pitch to about 3 parts of fluxing liquid per weight of pitch, thereby providing a fluid pitch having substantially all quinoline insoluble material suspended in the fluid in the form of a readily separable solid. The suspended solid is then separated by filtration of the like and the fluid pitch is then treated with the antisolvent compound so as to precipitate at least a substantial portion of the pitch free of quinoline insoluble solids.

The fluxing compounds suitable in the practice of the present invention include tetrahydrofuran toluene, light aromatic gas oil, heavy aromatic gas oil, tetralin and the like. The antisolvent preferably will be one of the solvents or mixture of solvents which have the solubility parameter between 8.0 and 9.5, preferably between about 8.7 and 9.2 at 25° C. as discussed hereinabove.

A more complete understanding of the process of this invention can be obtained by reference to the following examples which are illustrative only and are not meant to limit the scope thereof which is fully disclosed in the hereafter appended claims.

EXAMPLES 1-12

In each of the following examples, 12 kilograms, of a cat cracker bottom having the following physical inspections was used:

| | |
|---|---|
| Physical Characteristics | |
| Viscosity cst at 210° F. | 9.0 |
| Ash content, wt. % | 0.015 |
| Coking value (wt. % at 550° C.) | 6.9 |
| Asphaltene (n-heptane insolubles), % | 1.0 |
| Toluene insolubles (0.35μ), % | 0.150 |
| Number average mol. wt. | 280 |
| Elemental Analysis | |
| Carbon, % | 89.29 |
| Hydrogen, % | 7.92 |
| Oxygen, % | 0.15 |
| Sulfur, % | 2.90 |
| Chemical Analysis (by proton NMR) | |
| Aromatic carbon (atom %) | 56 |
| Carbon/hydrogen atomic ratio | 0.94 |
| Asphaltene Analysis | |
| Number average mol. wt. | 660 |
| Coking value (at 550° C.), % | 5.0 |
| Bureau of Mines Correlation Index | 125 |

The cat cracker bottom was charged into a 20 kilogram stainless steel reactor which was electrically heated and equipped with a mechanical agitator. A vacuum was applied during the heating and the pitch was distilled into seven fractions, the boiling point corrected to atmospheric pressure and weight percent of each fraction is given in Table IV below.

TABLE IV

| Fractions | Boiling Point °C./ 760 mm mercury | Wt. % |
|---|---|---|
| (Distillate) | 271-400 | 10.0 |
| (Distillate) | 400-427 | 23.8 |
| (Distillate) | 427-454 | 13.3 |
| (Distillate) | 454-471 | 11.7 |
| (Distillate) | 471-488 | 13.4 |
| (Distillate) | 488-510 | 10.0 |
| (Residue) | 510 + | 17.5 |

600 grams of samples of each of the fractions were charged into a 1000 ml glass reactor which was electrically heated and equipped with a mechanical agitator. The material charged into the reactor was heat soaked at atmospheric pressure and in a nitrogen atmosphere for the times and temperatures given in Table V below. Subsequently, the heat soaked material was cooled to about 300° C. and the pressure in the vessel is reduced to generally in the range from about 0.5 to 5.0 mm Hg and effectively vacuum stripping the heat soaked pitch of the oil contained therein.

The percent quinoline insolubles in the product pitch was determined by the standard technique of quinoline extraction at 75° C. (ASTM Test Method No. D2318/76).

The toluene insoluble fraction of the pitch was determined by the following process:

(1) 40 grams of crushed sample were mixed for 18 hours at room temperature with 320 ml of toluene. The mixture was thereafter filtered using a 10-15 micron fritted glass filter;

(2) the filter cake was washed with 80 ml of toluene, reslurried and mixed for four hours at room temperature with 120 ml of toluene, filtered using a 10-15 micron glass filter;

(3) the filter cake was washed with 80 ml of toluene followed by a wash with 80 ml of heptane, and finally the solid was dried at 120° C. in the vacuum for 24 hours.

The above method for determining toluene insolubles is hereinafter referred to as the SEP technique, which is an achronym for the standard extraction procedure.

The optical anisotropicity of the pitch was determined by first heating the pitch to 375° C. and then after cooling, placing a sample of the pitch on a slide with Permount, a histological mounting medium sold by the Fisher Scientific Company, Fairlawn, N.J. A slip cover was placed over the slide by rotating the cover under hand pressure, the mounted sample was crushed to a powder and evenly dispersed on the slide. Thereafter the crushed sample was viewed under polarized light at a magnification factor of 200× and the percent optical anisotropicity was estimated.

The text results for some samples are given in Table V below.

TABLE V

| Example No. | Feed Distillate, Boiling Point Range °C./760 mm Hg | Heat Soaking Condition Temp (°C.) | Heat Soaking Condition Time (hrs) | Pitch Composition Toluene Insoluble % | Pitch Composition Qi % | Optical Anisotropicity % |
|---|---|---|---|---|---|---|
| 1 | 427-454 | 420 | 3 | 21.0 | 0.1 | ND |
| 2 | 454-471 | 430 | 3 | 41.5 | 0.5 | ND |
| 3 | 471-488 | 420 | 3 | 27.0 | 0.3 | 100 |
| 4 | 471-488 | 430 | 3 | 40.0 | 0.8 | ND |
| 5 | 471-488 | 440 | 3 | 63.5 | 1.3 | ND |
| 6 | 488-510 | 420 | 3 | 37.0 | 0.1 | ND |
| 7 | 488-510 | 430 | 3 | 45.0 | 1.4 | 100 |
| 8 | Middle Distillate (1) | 430 | 3 | 45.0 | 0.4 | ND |
| 9 | Middle Distillate (1) | 430 | 5 | 64.0 | 2.7 | ND |
| 10 | Middle Distillate (1) | 430 | 5½ | 74.0 | 3.4 | 100 |
| 11 | Middle Distillate (1) | 430 | 5¾ | 77.0 | 5.1 | 100 |
| 12 | 510 + (Residue) | 420 | 3 | 43.5 | 17.0 | ND |

(1) boiling point range = 450°-510° C./760 mm Hg
ND - not determined

What is claimed is:

1. A process for preparing a pitch suitable for carbon artifact manufacture comprising:

providing a cat cracker bottom which boils in the range from about 200° C. to about 550° C.;

heating said cat cracker bottom to obtain a middle fractions distillate generally boiling in the range of from approximately 450° C. to 510° C.;

heat soaking said distillate at elevated temperatures to provide a pitch; and, vacuum stripping said heat soaked distillate to remove at least a portion of the heat soaked distillate which boils below about 400° C., thereby obtaining a pitch suitable for carbon artifact manufacture.

2. The process of claim 1 wherein said distillate is heat soaked at a temperature in the range of about 350° to about 500° C., for times ranging up to about 20 hours at 760 mm of mercury.

3. The process of claim 2 wherein from about 20% to about 60% of the heat soaked distillate boiling below 400° C. is removed.

4. The process of claim 3 wherein said heat soaking is conducted at temperatures in the range of from about 410° C. to about 440° C. at 760 mm of mercury.

5. The process of claim 4 wherein said heat soaking is conducted for about 2 to about 5 hours.

6. The process of claim 1 wherein said heat soaking is done in an inert atmosphere.

7. The process of claim 1 wherein said heat soaking is done in a hydrogen atmosphere.

8. The process for preparing a pitch suitable for carbon artifact manufacture comprising:

providing cat cracker bottom fractions boiling in the range from about 200° C. to about 550° C. at 760 mm of mercury;

heating said cat cracker bottom to temperatures in the range of about 200° C. to about 300° C. at pressures ranging from about 250 to 500 microns of mercury to obtain a middle fractions distillate;

heat soaking said distillate at temperatures in the range from about 390° C. to about 450° C. for times ranging from about 1 minute to about 20 hours to provide an oil-containing pitch; and, thereafter, vacuum stripping the heat soaked distillate at temperatures below about 400° C. and at pressures ranging from about 1 to 100 mm of mercury for time sufficient to remove at least a portion of the oil present in the oil-containing pitch whereby a pitch suitable for carbon artifact manufacture is obtained.

9. The process of claim 8 wherein from about 20% to about 60% of the oil present in the oil-containing pitch is removed.

10. A process for preparing a pitch suitable for carbon fiber production comprising:

treating a cat cracker bottom which boils in the range from about 200° C. to about 550° C. to obtain a middle fractions distillate boiling in the approximate range from about 450° C. to about 510° C. at 760 mm of mercury;

heat soaking the distillate at temperatures in the range from about 390° C. to about 450° C. for times ranging from about 1 minute to about 20 hours; and then, vacuum stripping said heat treated distillate at temperatures in the range of from about 320° C. to about 380° C. and at pressures ranging from about 1 to about 100 mm of mercury to remove from about 20% to about 60% of the oil present in said pitch;

treating said so-treated pitch with an organic solvent system having a solubility parameter at 25° C. of between about 8.0 and about 9.5, said treating being at a temperature and with an amount of organic solvent system sufficient to provide a solvent insoluble fraction which is thermally convertible into a deformable pitch containing greater than 75% of an optically anisotropic phase; and separating said solvent insoluble fraction whereby a pitch suitable for carbon fiber production is obtained.

11. A process for preparing a pitch suitable for carbon fiber production comprising:

treating a cat cracker bottom which boils in the range from about 200° C. to about 550° C. to obtain a middle fractions distillate boiling in the range from about 450° C. to about 510° C. at 760 mm of mercury;

heat soaking the distillate at temperatures in the range from about 390° C. to about 450° C. for times ranging from about 1 minute to about 20 hours; and then, vacuum stripping said heat treated distillate at temperatures in the range of from about 320° C. to about 380° C. and at pressures ranging from about 1 to about 100 mm of mercury to remove from about 20% to about 60% of the oil present in said pitch;

adding an organic fluxing liquid to said vacuum stripped pitch to provide a fluid pitch containing insoluble solids suspended therein, said organic fluxing liquid being employed in the range from about 0.5 to 3 parts by weight of liquid per part of pitch;

filtering said pitch to separate said solids;

treating said pitch with said separated fluid pitch with an organic solvent system having a solubility parameter at 25° C. between about 8.0 and about 9.5, said treating being at a temperature with an amount of organic solvent system sufficient to provide a solvent insoluble fraction which is thermally convertible into a deformable pitch containing greater than 75% of an optically anisotropic phase; and separating said solvent insoluble fraction whereby a pitch suitable for carbon fiber production is obtained.

* * * * *